US008256472B2

(12) United States Patent
De Vries et al.

(10) Patent No.: US 8,256,472 B2
(45) Date of Patent: Sep. 4, 2012

(54) METHOD OF REFILLING A CONTAINER AND AN AUXILIARY DEVICE FOR REFILLING A CONTAINER FROM A RESERVOIR

(75) Inventors: Bartele Hendrik De Vries, Drachten (NL); Reinier Niels Lap, Surhuizum (NL); Olaf Martin De Jong, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 307 days.

(21) Appl. No.: 12/515,971

(22) PCT Filed: Nov. 27, 2007

(86) PCT No.: PCT/IB2007/054808

§ 371 (c)(1),
(2), (4) Date: May 22, 2009

(87) PCT Pub. No.: WO2008/065612

PCT Pub. Date: Jun. 5, 2008

(65) Prior Publication Data

US 2010/0051133 A1 Mar. 4, 2010

(30) Foreign Application Priority Data

Nov. 30, 2006 (EP) ..... 06125086

(51) Int. Cl.
*B65B 1/04* (2006.01)
*B65B 3/04* (2006.01)
*B65B 31/00* (2006.01)

(52) U.S. Cl. ..... 141/28; 141/27; 141/18; 141/369; 222/173; 30/41

(58) Field of Classification Search ..... 141/18, 141/27, 28, 369; 30/41; 222/173
See application file for complete search history.

(56) References Cited

U.S. PATENT DOCUMENTS

| | | | | |
|---|---|---|---|---|
| 3,797,534 | A | 3/1974 | Skidmore | |
| 3,935,883 | A * | 2/1976 | Stach et al. | 141/27 |
| 4,345,627 | A | 8/1982 | Cassia | |
| 4,696,106 | A | 9/1987 | Cross et al. | |
| 4,883,101 | A * | 11/1989 | Strong | 141/27 |
| 4,886,192 | A | 12/1989 | Cassia | |
| 4,938,260 | A | 7/1990 | Hirz | |
| 5,647,409 | A * | 7/1997 | Christ et al. | 141/27 |
| 5,911,252 | A * | 6/1999 | Cassel | 141/234 |
| 6,036,056 | A | 3/2000 | Lee et al. | |
| 2003/0037447 | A1 * | 2/2003 | Gruber et al. | 30/537 |

FOREIGN PATENT DOCUMENTS

| | | |
|---|---|---|
| DE | 2736532 | 11/1978 |
| EP | 0557194 A1 | 2/1993 |
| EP | 1739018 A1 | 1/2007 |
| WO | 2006067667 A1 | 6/2006 |

* cited by examiner

*Primary Examiner* — Dinh Q Nguyen

(57) ABSTRACT

A domestic appliance apparatus having a container is connectable to a fluid-containing reservoir that includes a movable actuator for activating a pump for dispensing the fluid. The reservoir is put in communication with the container and the actuator is activated by an auxiliary device to transfer a quantity of fluid from the reservoir to the container. The auxiliary device includes a housing which accommodates a holder for holding the reservoir and an actuator driver for activating the actuator. The auxiliary device may be part of a refilling assembly, which also includes the reservoir and/or the refillable container.

12 Claims, 3 Drawing Sheets

METHOD OF REFILLING A CONTAINER AND AN AUXILIARY DEVICE FOR REFILLING A CONTAINER FROM A RESERVOIR

FIELD OF THE INVENTION

The invention relates to a method of refilling a container.

BACKGROUND OF THE INVENTION

Certain personal care devices such as some types of shavers are provided with a container which is filled with a fluid, for example lotion or soap, so as to provide the possibility to supply the fluid to a part of the device where it is desired. When the container is empty the user may replace it by a filled container. It is however desired that the user can refill the container by himself, for example by connecting it to a fluid-containing reservoir and transfer a quantity of fluid from the reservoir to the container. It appears that some people have the experience that this is a rather difficult operation.

SUMMARY OF THE INVENTION

It would be advantageous to provide a simple method of refilling a container for a domestic appliance apparatus.

In one embodiment, a reservoir has a movable actuator for dispensing the fluid can be used such that a quantity of fluid can be transferred to the container without the necessity of applying a manual force upon the actuator of the reservoir but using a powered auxiliary device. The powered auxiliary device delivers work for activating the actuator and may function by way of electrical, pneumatical, hydraulical or magnetical energy. The domestic appliance apparatus may be a shaver, a tooth brush or the like. The fluid may be a lotion, a gel or emulsion, such as a shaving lotion, shaving emulsion, tooth paste, mouth washing lotion or the like.

In practice, this means for example, that people who already use this type of reservoir can still use this, but then without the need for manual operation when refilling the container. Particularly, this is a benefit to elderly and disabled persons for whom manually refilling appears to be rather strenuous.

In another embodiment, the reservoir comprises a pump which is activated via the actuator by a reciprocating motion. This provides a practical method of refilling since a known type of reservoir has a pump including an actuator to be activated by a reciprocating motion.

In another embodiment, the actuator is activated between a neutral position and a maximal stroke, in which neutral position a negligible force is applied on the actuator, where the actuator is moved to the neutral position after a refilling operation. This guarantees that the actuator is in its neutral position when the reservoir is replaced. This facilitates replacement of the container without already dispensing fluid when installing a filled reservoir on the powered auxiliary device due to applying a force on the actuator.

In another embodiment, an auxiliary device is suitable to apply the method such as described above and is therefore advantageous. The auxiliary device includes an actuator driver for activating a movable actuator of the reservoir when this reservoir is connected to a holder so as to transfer the fluid to an outlet of the auxiliary device. A further advantage is that the auxiliary device is also capable of dispensing a quantity of fluid to another receiver than a container for a domestic appliance apparatus. The powered driving means may function by way of electrical, pneumatical, hydraulical or magnetical energy, or alternatively on the basis of a venturi effect.

In another embodiment, the auxiliary device comprises a transmission that provides the opportunity to adjust the speed and direction of the motion of the actuator driver with respect to that of the driving means.

In another embodiment, the actuator driver is integrated with a fluid transfer conduit, hence resulting in a compact auxiliary device.

In another embodiment, the auxiliary device is suitable for receiving certain known reservoirs having an actuator requiring a reciprocating motion, for example for activating a pump in the reservoir.

In another embodiment, the transmission comprises an eccentrical mechanism which is an effective and reliable mechanism to create a reciprocating motion.

In another embodiment, the transmission comprises a cam-shaped wheel which is a simple and low-cost eccentrical mechanism.

In another embodiment, the auxiliary device has a rotatable lever which is mounted to the housing at a distance from an axis of rotation of the cam-shaped wheel. This has the advantage that the actuator driver has a reciprocating motion with respect to the axis of rotation of the lever whereas the amplitude of the lever near the axis of rotation is very low. This means that the motion of the outlet with respect to the housing is small or even negligible which facilitates a connection to the refillable container or avoids dispensed fluid to be flung out in different directions after exiting the outlet. A releasable mounting of the actuator driver and the outlet to the lever facilitates cleaning of these components.

In another embodiment, the auxiliary device has a second holder and is typically suitable to refill a container separately or as a part of an apparatus, having an inlet connector which is compatible to the outlet connector of the auxiliary device. The apparatus containing the refillable container may be a domestic appliance or personal care appliance apparatus, such as a shaver or a tooth brush. In the case of a tooth brush the fluid may be tooth paste or gel. If the second holder is adapted to receive an apparatus it may also be adapted to recharge a battery of the apparatus when the apparatus is connected to the second holder. In this case the housing may accommodate a battery charging system, as well.

In another embodiment, the housing is provided with a clamping mechanism for removably fixing the reservoir to the holder. This prevents the reservoir from being moved with respect to the holder when the actuator driver activates the actuator of the reservoir. After fitting the reservoir to the holder of the auxiliary device the reservoir can be clamped to the holder by the clamping means. As a consequence, the reservoir has a fixed position with respect to the holder and the housing. This avoids the motion of the reservoir together with the motion of the actuator driver when the auxiliary device is operated.

In another embodiment, the clamping mechanism comprises a resilient element. This prevents the auxiliary device from being overloaded, for example in the case of a stuck actuator of the reservoir. In that case, when the force of the actuator driver on the actuator exceeds the back force of the resilient element, the entire reservoir is moved with respect to the housing of the auxiliary device.

It is noted that an automatic dispensing system for soap is well-known, for example from the U.S. Pat. No. 6,036,056. This device includes an electric motor, a motor reducing gear set and an eccentric wheel which pushes against a squeezer set which squeezes a soap hose to dispense liquid soap. The soap hose communicates with a reservoir which is filled with liquid soap. However, the known dispensing device is not arranged for a reservoir having a movable actuator for dispensing the soap.

The above-mentioned aspects and other aspects of the invention will be apparent from the following description with reference to the drawings.

The invention also includes any possible combination of features or subject matter as claimed in any one of the claims.

DETAILED DESCRIPTION OF EMBODIMENTS

Figure 1:
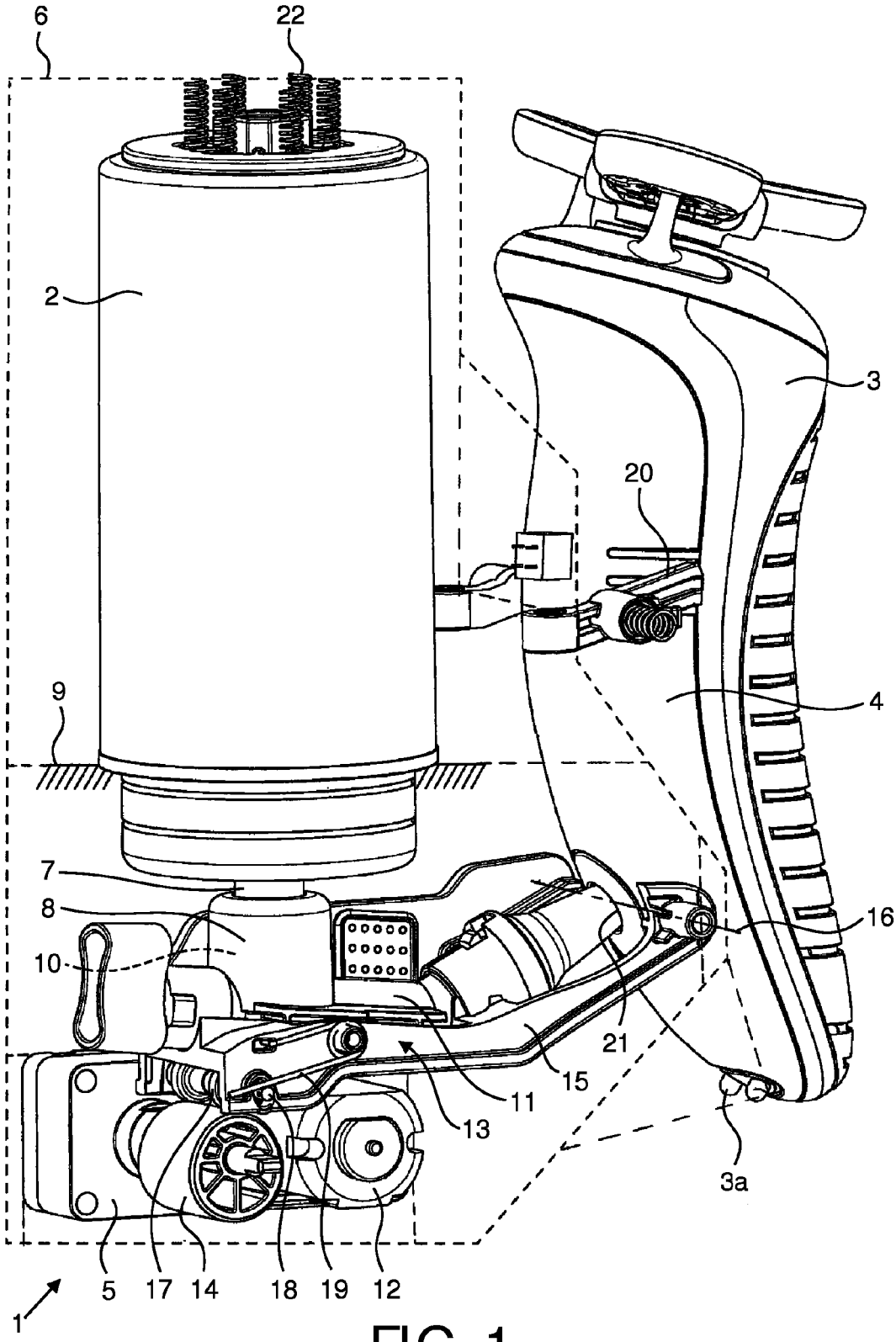
FIG. 1 is a perspective view of an embodiment of a refilling assembly, provided with a shaver.
Figure 2:
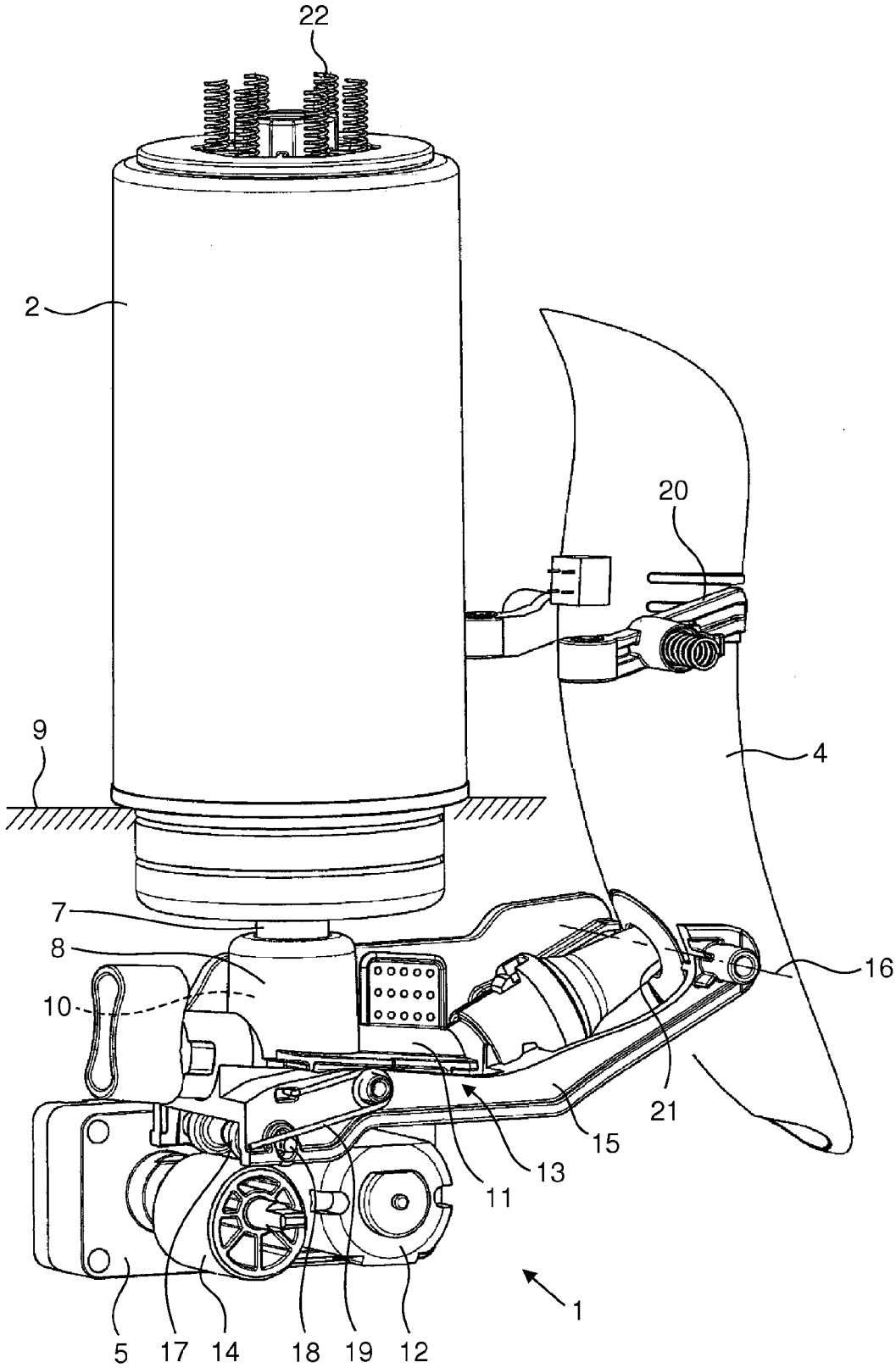
FIG. 2 is a similar view as FIG. 1, but the assembly is provided with a refillable container only.

FIG. 1 shows an embodiment of a refilling assembly comprising a powered auxiliary device 1, a fluid-containing reservoir 2 and a shaver 3. In FIG. 2 the shaver 3 is replaced by a refillable container 4 only. The embodiment of the auxiliary device 1 such as shown in FIGS. 1 and 2 is used to refill a container 4 attached to or integrated in a shaver 3, or to refill a separate container 4, respectively. Of course, the auxiliary device 1 can also be used for refilling a container 4 for other types of domestic appliance apparatus.

In general, certain types of domestic appliance apparatus for personal care are provided with a refillable container which is filled with a fluid, for example lotion or soap, so as to provide the possibility to supply the fluid to a part of the device where it is desired. In the case of a shaver 3 shaving cream is desired near razor blades of the shaver 3 so as to improve the shaving quality. When the container 4 is empty the user may replace it by a filled container 4. In the case of FIG. 1, however, the shaver 3 including the container 4 can be refilled automatically. In the case of FIG. 2 the container 4 separated from the shaver 3 can be refilled automatically.

The auxiliary device 1 comprises a housing 6 (virtually shown by a broken line in FIG. 1). The housing 6 accommodates a holder 9 for holding the reservoir 2. The holder 9 has a fixed position with respect to the housing 6. The auxiliary device 1 is also provided with a second holder 20, which is shown in FIGS. 1 and 2. In the shown embodiment the second holder 20 projects from the housing 6. The second holder 20 is arranged for holding the refillable container 4 or an apparatus 3 including a refillable container 4. The apparatus may be a domestic appliance or personal care appliance apparatus, such as a shaver (shown in FIG. 1) or a tooth brush.

The second holder 20 can also be a combined one, which is suitable for refilling a container 4 as well as recharging a battery of the shaver 3 in the case that the shaver 3 is provided with a battery. In that case the housing 6 may also accommodate a battery charger and be provided with an electrical connector (not shown) which mates with an electrical connector 3*a* of the shaver 3, such as shown in FIG. 1.

Figure 3:
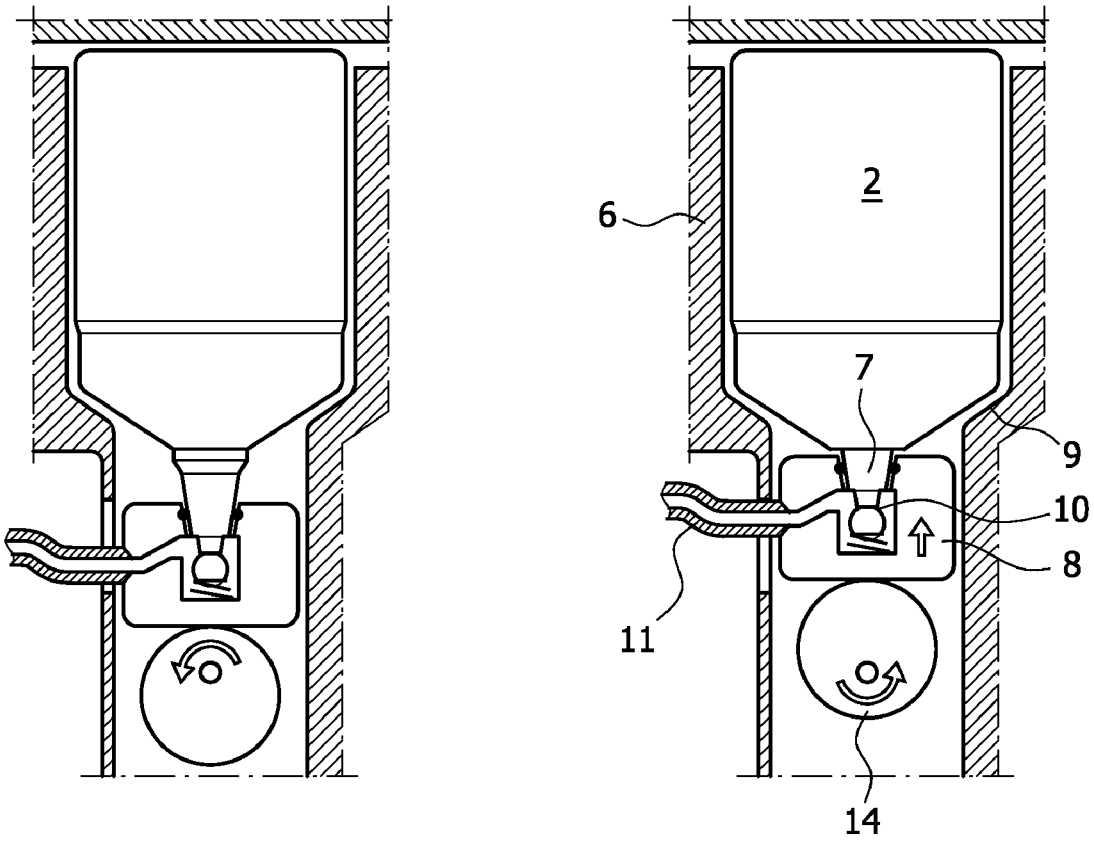
FIG. 3 is a schematic view of an embodiment of the auxiliary device and a reservoir, illustrating the operation principle.

The reservoir 2 includes a movable actuator 7 for activating pressure means to dispense a quantity of fluid out of the reservoir 2, see also FIG. 3. In the embodiments of FIGS. 1, 2 and that of FIG. 3 the pressure means are formed by a pump in the reservoir 2 which functions by a reciprocating motion of the actuator 7 substantially parallel to the longitudinal axis of the reservoir 2. A reservoir 2 having its own pump is known and commercially available. However, for some people, such as elderly and disabled persons it is too strenuous to operate the pump manually.

The auxiliary device 1 according to the invention is provided with an actuator driver 8 for activating the actuator 7 of the reservoir 2 when this is connected to a holder 9, which holder 9 is fixed to the housing 6. The actuator driver 8 comprises a fluid receiving chamber 10, such as shown in FIG. 3 (this cannot be seen in FIGS. 1 and 2). This means that the actuator driver 8 has at least two functions: 1) activating the actuator 7 of the reservoir 2 and 2) receiving and transferring the dispensed fluid through a conduit 11 in the direction of an outlet of the auxiliary device 1. FIG. 3 shows that the receiving chamber 10 communicates with the outlet of the reservoir 2 and the conduit 11. Thus, the actuator driver 8 forms an interface between the reservoir 2 and the conduit 11. The actuator driver 8 and the conduit 11 may be releasably mounted to the auxiliary device 1 so as to enable cleaning thereof.

The embodiment of the auxiliary device 1 such as shown in FIGS. 1 and 2 further comprises an electric motor 12 as a powered driving means for driving the actuator driver 8 via a transmission 13. In order to create a reciprocating motion of the actuator driver 8 the transmission 13 is provided with a cam-shaped wheel 14 as an eccentrical mechanism, which eccentrical wheel 14 is driven by the electric motor 12 via a gearbox 5. The gearbox 5 is fixed to the housing 6. The transmission 13 further comprises a lever 15 which is rotatable around an axis of rotation 16 and mounted to the housing 6 at a distance from the axis of rotation of the cam-shaped wheel 14 as seen in a direction perpendicular to the direction of the reciprocating motion. Note, that in the embodiment of FIG. 3 the cam-shaped wheel 14 directly contacts the actuator driver 8.

The pumping speed can be adjusted by varying the rotation speed of the cam-shaped wheel 14. The dispensed quantity per pumping stroke is defined by the rate of eccentricity of the cam-shaped wheel 14. Furthermore, the cam may have a special profile so as to obtain an optimal acceleration of the actuator driver 8.

The cam-shaped wheel 14 contacts the lever 15 via rollers 17. The rollers 17 are connected to an axle 18, which is movably connected to the lever 15 via a spring 19. This is a common way of mechanically connecting the cam-shaped wheel 14 to the actuator driver 8. The spring 19 has the effect of eliminating play in the mechanism between the actuator 7 of the reservoir 2 and the cam-shaped wheel 14. Play might have been caused by production tolerances of the dimensions of the reservoir 2.

The distance between the axis of rotation 16 and the actuator driver 8 is such that the actuator driver 8 approaches a linear movement.

The outlet of the auxiliary device 1 ends up in a connector 21 which is adapted to mate with a counterpart of the container 4 or apparatus 3 so as to enable transfer of fluid from the reservoir 2 to the refillable container 4 or apparatus 3. The conduit 11 is releasably connected to the lever 15 which means that the conduit 11 moves together with the lever 15 when the device 1 is in operation. The connector 21 is located near the axis of rotation 16, which means that during operation of the auxiliary device 1 the amplitude of the connector 21 is small. When the refillable container 4 or apparatus 3 is connected to the second holder 20. The small amplitude of the connector 21 prevents the container 4 or apparatus 3 from vibrating on the second holder 20.

The housing 6 is further provided with a clamping mechanism for removably fixing the reservoir 2 to the holder 9. The clamping mechanism may clamp the reservoir 2 to the holder 9 after placing the reservoir 2 on the holder 9. This results in a fixed position of the reservoir 2 with respect to the housing 6. The clamping mechanism avoids the motion of the reservoir 2 together with the motion of the actuator driver 8 when the auxiliary device 1 is operated. In the embodiment shown in FIGS. 1 and 2 the clamping mechanism comprises a resilient element in the form of coil springs 22. This prevents the auxiliary device 1 from being overloaded in the case when the actuator 7 is stuck, for example. The spring force of the coil springs 22 is preferably higher than the pumping force, such that under normal conditions the actuator driver 8 is moved with respect to the reservoir 2.

A commercially available reservoir 2 may have an outlet port which directly fits into an inlet port of the container 4 so as to enable the user to fill the container 4 manually. As the auxiliary device 1 has the function of an intermediate component it is very useful when the actuator driver 8 has the same connector features as the inlet port of the container 4.

The embodiment of the auxiliary device 1 such as shown in FIGS. 1 and 2 is very suitable to apply the method of refilling a container 4 according to the present invention. The reservoir 2 can be put in communication with the container 4 whereas the auxiliary device 1 can activate the actuator 7 of the reservoir 2. Due to the presence of the receiving chamber 10 within the actuator driver 8 the reservoir 2 can be put in communication with the container 4 through the auxiliary device 1.

The actuator driver 8 can be activated between a neutral position and a maximal stroke. The neutral position is shown in the left picture of FIG. 3 and a nearly maximal stroke is shown in the right picture of FIG. 3. In the neutral position the force applied on the actuator 7 is negligible. It is advantageous to move the actuator driver 8 to the neutral position after a refilling operation, because of easier replacement of the reservoir 2 when necessary. It facilitates the replacement of the reservoir 2 without already dispensing fluid when installing a filled reservoir 2 to the auxiliary device 1.

From the foregoing it will be clear that the invention provides a method of refilling a container, an auxiliary device and a refilling assembly. According to the invention refilling of a container for a domestic appliance apparatus is very simple.

The invention is not restricted to the above-described embodiments as shown in the drawings, which can be varied in several ways without departing from the scope of the claims. It is for example not necessary that the actuator driver 8 and the receiving chamber 10 are integrated. It is for example, possible that the actuator 7 of the reservoir 2 is located at a different position with respect to the dispensing outlet of the reservoir 2. Furthermore, it is possible that the auxiliary device is not only used for refilling a container for a domestic appliance apparatus, but also for dispensing fluid in the hands of a user. In that case a simple device is provided for people who cannot operate a commercially available reservoir 2 as described above, but wish to use the reservoir 2 and the auxiliary device 1 as an automated fluid dispensing unit.

In general it is noted that, in this application, the expression "comprising" does not exclude other elements or steps, and "a" or "an" does not exclude a plurality. Reference signs in the claims shall not be construed as limiting the scope thereof.

The invention claimed is:

1. An auxiliary device comprising a housing, wherein the housing comprises:

a holder for holding a fluid-containing reservoir, said fluid-containing reservoir including a movable actuator for activating a pressure unit to dispense a quantity of fluid;

an actuator driver for activating the movable actuator of the fluid-containing reservoir when the fluid-containing reservoir is connected to the holder so as to transfer the quantity of fluid to an outlet of the auxiliary device and from the outlet to the a refillable container connectable to outlet through a conduit;

a powered driver configured to drive the actuator driver; and a transmission for drivingly coupling the actuator driver to the powered driver, wherein the transmission comprises a cam-shaped wheel and a lever rotatable around an axis of rotation of the lever and mounted to the housing at a distance from an axis of rotation of the cam-shaped wheel as seen in a direction perpendicular to a direction of the reciprocating motion so that vibration near the axis of rotation of the lever is reduced compared to a vibration near the cam-shaped wheel, wherein the outlet of the auxiliary device is located near the axis of rotation of the lever, and wherein the cam-shaped wheel contacts the lever and the actuator driver is releasably mounted to the lever, and the conduit is releasably connected to the lever so that the conduit moves together with the lever when the auxiliary device is in operation.

2. The auxiliary device as claimed in claim 1, wherein the actuator driver comprises a fluid receiving chamber with which an outlet of the fluid-containing reservoir and a conduit for transferring the quantity of fluid to the outlet of the auxiliary device communicates.

3. The auxiliary device as claimed in claim 2, wherein the transmission generates a reciprocating motion for the actuator driver.

4. The auxiliary device as claimed in claim 3, wherein the transmission comprises an eccentrical mechanism to generate the reciprocating motion.

5. The auxiliary device as claimed in claim 1, wherein the auxiliary device further comprises:

a second holder for holding the refillable container or an apparatus including the refillable container, wherein the outlet of the auxiliary device ends up in a connector for mating with a counterpart of the refillable container or the apparatus so as to enable transfer of the quantity of fluid from the fluid-containing reservoir to the refillable container or the apparatus.

6. The auxiliary device as claimed in claim 1, wherein the housing comprises a clamping mechanism for removably fixing the fluid-containing reservoir to the holder.

7. The auxiliary device as claimed in claim 6, wherein the clamping mechanism comprises a resilient element.

8. A refilling assembly comprising the auxiliary device as claimed in claim 1, and the fluid-containing reservoir containing the quantity of fluid and including the movable actuator for activating the pressure unit to dispense the quantity of fluid.

9. The refilling assembly according to claim 8, wherein the auxiliary device further comprises a second holder for holding the refillable container or an apparatus including the refillable container, wherein the outlet of the auxiliary device ends up in a connector releasably connectable to a counterpart of the refillable container or the apparatus for providing a communication between the refillable container and the outlet of the auxiliary device.

10. A refilling assembly comprising an auxiliary device as claimed in claim 1, wherein the auxiliary device further comprises a second holder for holding the refillable container or an apparatus including the refillable container, wherein the outlet of the auxiliary device ends up in a connector releasably connectable to a counterpart of the refillable container or the apparatus for providing a communication between the refillable container and the outlet of the auxiliary device.

11. The auxiliary device of claim 1, further comprising a second holder for holding an apparatus including the refillable container, wherein the second holder further comprises an electrical connector configured for connection to a further electrical connector of the apparatus for recharging a battery of the apparatus.

12. The auxiliary device of claim 11, wherein the outlet of the auxiliary device ends up in a connector for mating with a counterpart of the apparatus so as to enable transfer of the quantity of fluid from the fluid-containing reservoir to the refillable container of the apparatus.

* * * * *